US005640782A

United States Patent [19]

Deshpande et al.

[11] Patent Number: 5,640,782

[45] Date of Patent: Jun. 24, 1997

[54] VACUUM ROLL APPARATUS

[75] Inventors: Rajendra D. Deshpande, South Beloit, Ill.; William R. McGraw, Beloit, Wis.; Jeffrey H. Pulkowski, Roscoe, Ill.

[73] Assignee: Beloit Technologies, Inc., Wilmington, Del.

[21] Appl. No.: 559,017

[22] Filed: Nov. 15, 1995

Related U.S. Application Data

[63] Continuation of Ser. No. 119,927, Sep. 10, 1993, Pat. No. 5,542,192.

[51] Int. Cl.[6] ..... F26B 11/02

[52] U.S. Cl. ..... 34/115; 34/120

[58] Field of Search ..... 34/114, 115, 116, 34/117, 120, 123

[56] References Cited

U.S. PATENT DOCUMENTS

| | | | |
|---|---|---|---|
| 4,876,803 | 10/1989 | Wedel | 34/117 |
| 4,934,067 | 6/1990 | Wedel | 34/457 |
| 4,980,979 | 1/1991 | Wedel | 34/458 |
| 5,031,338 | 7/1991 | Wedel | 34/115 |
| 5,347,728 | 9/1994 | Pinter et al. | 34/115 |
| 5,371,954 | 12/1994 | Pinter et al. | 34/115 |

FOREIGN PATENT DOCUMENTS 4222815 7/1992 Germany .

OTHER PUBLICATIONS

Topics in Applied Physics, vol. 45, Section 3, "Hydrodynamic Stability and Bifurcation" by D.D. Joseph—pp. 27–77.

Topics in Applied Physics, vol. 45, Section 6, "Instabilities & Transition in Flow Between Concentric Rotating Cylinders" by R. C. Di Prima & H.L. Swinney, pp. 139–180.

*Primary Examiner*—John M. Sollecito
*Assistant Examiner*—Steve Gravini
*Attorney, Agent, or Firm*—Dirk J. Veneman; Raymond W. Campbell; David J. Archer

[57] ABSTRACT

A vacuum roll apparatus is disclosed for transferring a web supported on a dryer felt from a first to a second drying cylinder of a dryer section. The apparatus includes a rotatable perforate shell having a first and a second end, the shell defining a cavity which extends from the first to the second end of the shell. The arrangement is such that the dryer felt extends from the first dryer around the perforate shell to the second dryer with the web extending contiguously with the dryer felt, and the dryer felt being disposed between the shell and the web. At least one fin is rigidly secured to the shell and is disposed within the cavity such that when the shell is rotated, the fin generates a flow of air through the perforate shell towards the cavity for drawing the web into close conformity with the dryer felt during movement thereof around the vacuum roll apparatus so that the web is restrained against cross-machine directional shrinkage.

4 Claims, 3 Drawing Sheets

VACUUM ROLL APPARATUS

This is a continuation of application Ser. No. 08/119,927 filed on Sep. 10, 1993, now U.S. Pat. No. 5,542,192 issued Aug. 6, 1996.

BACKGROUND OF THE INVENTION

Field of the Invention

The present invention relates to a vacuum roll apparatus for transferring a web supported on a dryer felt from a first to a second drying cylinder of a dryer section. More specifically, the present invention relates to a vacuum roll apparatus for a dryer section in which the dryer felt is disposed between the web and the vacuum roll apparatus during movement thereof past the vacuum roll apparatus.

Information Disclosure Statement

With the introduction by Beloit Corporation of the Bel-Champ™ type dryer section, drying speeds have been greatly increased. Additionally, the quality of the resultant sheet has improved, particularly due to an enhanced cross-machine directional restraint of the web during movement thereof through the dryer section. Bel-Champ is a common law trademark of Beloit Corporation.

However, with the Bel-Champ™ type dryer section as disclosed in U.S. Pat. No. 4,934,067, a vacuum roll is disposed between each adjacent drying cylinder.

Such vacuum rolls typically use cross-machine directional internal seals or glands to isolate vacuum substantially within the region of the roll covered by the paper and dryer fabric. The provision of such seals involves considerable expenditure in terms of initial capital outlay and maintenance costs.

In an attempt to reduce the aforementioned costs, field trials have been carried out on vacuum rolls in which the internal seals were removed so that a vacuum be applied to a cavity extending along the length of a perforate roll shell.

Generally, these trials suggested that above speeds of 1,000 feet per minute, insufficient vacuum is available at the roll surface, even when relatively high vacuum levels are applied to the roll to hold the web onto the dryer felt.

One explanation of the aforementioned problem is that due to the high rotational speed of the roll shell, laminarization or retransition from turbulent to laminar flow takes place. During rotation at high speeds, viscous effects cannot be neglected near the roll surface. Formation of closed vortices at the center of the roll become a real possibility. Such a phenomena is addressed in an article entitled "Topics In Applied Physics", Volume 45, under the heading "Hydrodynamic Instabilities and The Transition to Turbulence" by H. L. Swinney and J. P. Gollub.

Additionally, at the exit region of the roll shell, that is from the ends of the roll shell and the stationary pipe connected to a vacuum source, sudden changes in rotational speed causes the flow to become unstable and the development of air flow is delayed.

The present invention overcomes the viscous effects near the internal surface of the roll shell and disrupts closed vortices at the center of the roll shell by means of fins attached to the inside of the vacuum roll.

Additionally, in order to overcome the instability of the flow from the vacuum roll to the pipe connecting the roll to the vacuum source, flow deflectors are installed, such deflectors rotating with the roll shell.

Therefore, it is a primary objective of the present invention to provide a vacuum roll apparatus which overcomes the aforementioned problems associates with the prior art arrangements and which makes a considerable contribution to the art of drying a web of paper.

Another object of the present invention is the provision of a vacuum roll apparatus which overcomes the problem of laminarization or retransition from turbulent to laminar flow.

Another object of the present invention is the provision of a vacuum roll apparatus which overcomes the problem of viscous effects at high rotational speeds of the vacuum roll apparatus and close vortices at the center of the roll.

Another object of the present invention is the provision of a vacuum roll apparatus which requires less capital outlay and maintenance costs relative to prior art vacuum rolls.

Another object of the present invention is the provision of a vacuum roll apparatus which does not require internal seals for contacting the inner surface of a roll shell, thereby reducing the costs involved in machining the internal surface of the vacuum roll to demanding tolerances.

Another object of the present invention is the provision of a vacuum roll apparatus in which the maintenance costs thereof are reduced due to the elimination of wearing contact of the surface of the seal relative to the internal surface of the roll shell.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a vacuum roll apparatus for transferring a web supported on a dryer felt from a first to a second drying cylinder of a dryer section. The apparatus includes a rotatable perforate shell having a first and a second end. The shell defines a cavity which extends from the first to the second end of the shell. The arrangement is such that the dryer felt extends from the first dryer around the perforate shell to the second dryer. The web extends contiguously with the dryer felt, with the dryer felt being disposed between the shell and the web.

Fin means are rigidly secured to the shell and are disposed within the cavity. The arrangement is such that when the shell is being rotated, the fin means generate a flow of air through the perforate shell towards the cavity. Such flow of air draws the web into close conformity with the dryer felt during movement thereof around the vacuum roll apparatus so that the web is restrained against cross-machine directional shrinkage.

In a more specific embodiment of the present invention, the perforate shell is cylindrical in configuration and includes an outer cylindrical surface which defines a plurality of holes which extend from the outer surface to the cavity.

In one embodiment of the present invention, the fin means includes a fin which extends substantially diametrically across the cavity from the first to the second end thereof.

In another embodiment of the present invention, the fin means includes a first fin which is rigidly secured to the shell along the length thereof between the first and second ends of the shell. The first fin is curved with a radius of curvature which is less than the radius of curvature of the shell. The first fin has a proximal and a distal end with the proximal end being secured to the shell and the distal end being disposed within the cavity.

Additionally, the fin means includes a second fin which is rigidly secured to the shell along the length thereof between the first and second end of the shell. The second fin is secured diametrically opposite to the first fin. The second fin is curved in an opposite direction to the first fin and has a radius of curvature which is less than the radius of curvature of the shell. The second fin has a proximal and a distal end with the proximal end being secured to the shell diametrically opposite to the proximal end of the first fin. The distal end of the second fin is disposed within the cavity such that when the shell is rotated, the fins interact with one another within the cavity for generating the flow of air through the perforate shell towards the cavity.

In a further embodiment of the present invention, the fin means includes a plurality of fins with each fin being secured to the shell and disposed within the cavity in a spiral configuration. Each of the fins includes a proximal end secured to the shell and a distal end extending towards a rotational axis of the shell. The arrangement is such that when the shell rotates, the flow of air through the shell towards the cavity is generated, the fins also pumping the air towards the first and second ends of the shell.

More specifically, each of the fins of the plurality of the fins further include a threaded bore which extends from the proximal end towards the distal end. Each of the fins also includes a threaded fastener which extends through an aperture defined by the shell. The threaded fastener also cooperates with the threaded bore for anchoring the fin within the cavity.

In yet another embodiment of the present invention, the vacuum roll apparatus includes a first cone-shaped flow deflector disposed adjacent to the first end of the shell.

A second cone-shaped flow deflector is disposed adjacent to the second end of the shell, the arrangement being such that the apices of the flow deflectors face towards each other and are disposed within the cavity for facilitating a smooth flow of the air from the cavity.

Many modifications and variations of the present invention will be readily apparent to those skilled in the art by a consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
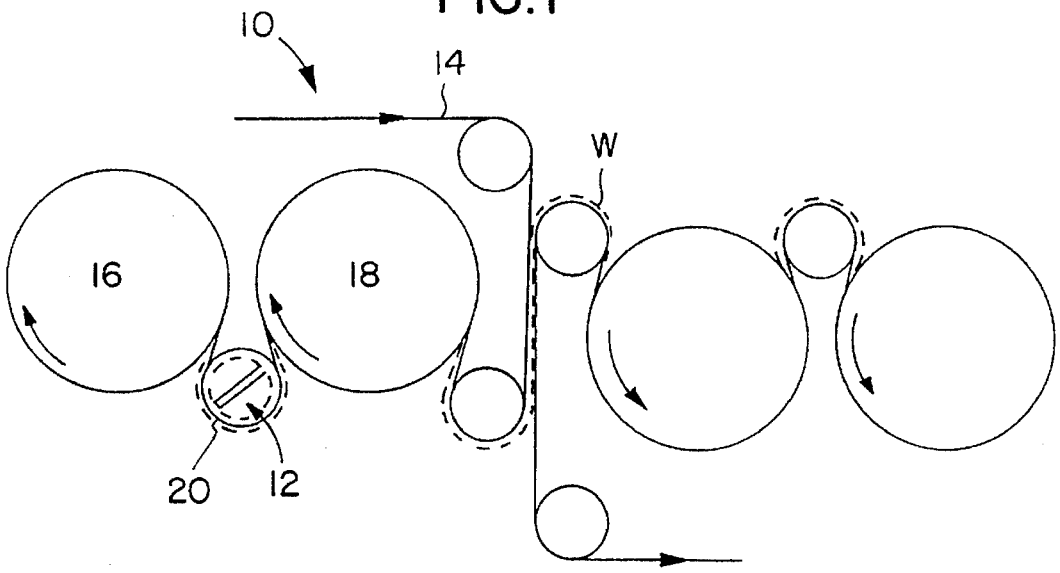
FIG. 1 is a side-elevational view of a dryer apparatus which includes a vacuum roll apparatus according to the present invention.

FIG. 1 is a side-elevational view of a dryer section, generally designated 10, which includes a vacuum roll apparatus, generally designated according to the present invention, for transferring a web W supported on a dryer felt 14 from a first to a second drying cylinder 16 and 18, respectively.

Figure 2:
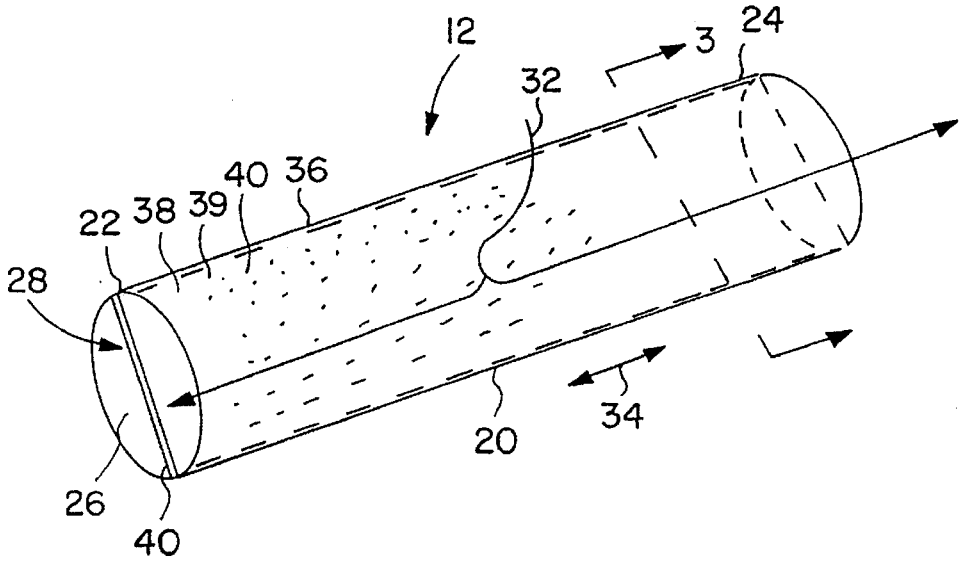
FIG. 2 is a perspective view of a vacuum roll apparatus according to the present invention as shown in FIG. 1.

The vacuum roll apparatus 12 includes a rotatable perforate shell 20 having a first and a second end 22 and 24, respectively, shown in FIG. 2. The shell 20 defines a cavity 26 which extends from the first end 22 to the second end 24 of the shell 20. The arrangement is such that the dryer felt 14 extends from the first dryer 16 around the perforate shell 20 to the second dryer 18. The web W extends contiguously with the dryer felt 14 with the dryer felt 14 disposed between the shell 20 and the web W.

As shown in FIG. 2, the vacuum roll apparatus 12 includes fin means, generally designated 28, rigidly secured to the shell 20 and disposed within the cavity 26. The arrangement is such that when the shell 20 is being rotated, as indicated by the arrow 30 shown in FIG. 3, the fin means 28 generates a flow of air, as indicated by the arrow 32. The flow of air 32 extends through the perforate shell 20 towards the cavity 26 for drawing the web W into close conformity with the dryer felt 14 during movement thereof around the vacuum roll apparatus 12 so that the web W is restrained against cross-machine directional shrinkage thereof, as indicated by the arrow 34.

As shown in FIG. 2, the perforate shell 20 is cylindrical in configuration, having an outer cylindrical surface 36 which defines a plurality of holes 38, 39 and 40 which extend from the outer surface 36 to the cavity 26.

Figure 3:
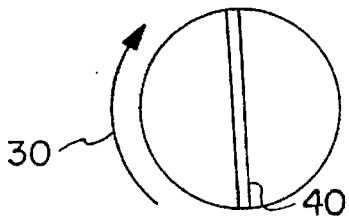
FIG. 3 is a sectional view taken on the line 3—3 of FIG. 2.

In a first embodiment of the present invention as shown in FIGS. 1–3, the fin means 28 include a fin 40 which extends substantially diametrically across the cavity 26 from the first end 22 to the second end 24 of the shell 20.

Figure 4:
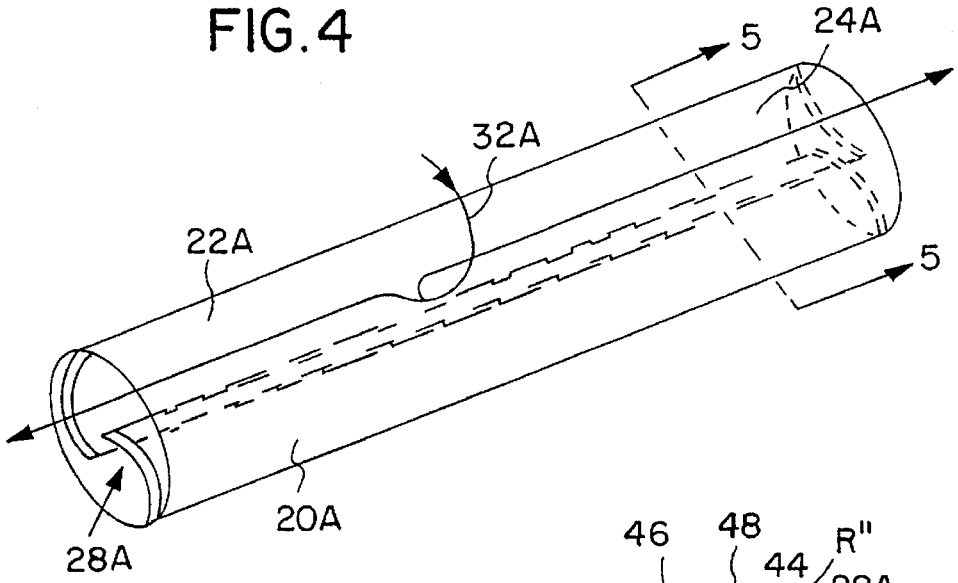
FIG. 4 is a perspective view similar to that shown in FIG. 2, but shows a further embodiment of the present invention.
Figure 5:
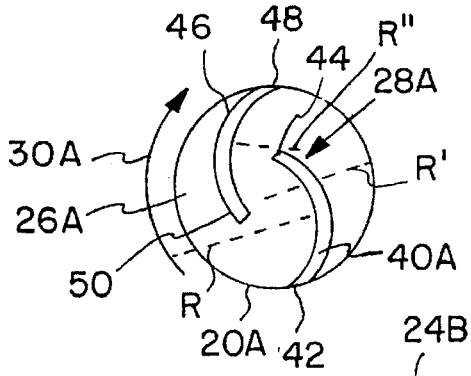
FIG. 5 is a sectional view taken on the line 5—5 of FIG. 4.

In another embodiment of the present invention as shown in FIGS. 4 and 5, the fin means 28A includes a first fin 40A which is rigidly secured to the shell 20A along the length thereof between the first end 22A and the second end 24A of the shell 20A. The first fin 40A is curved with a radius of curvature R which is less than the radius of curvature R' of the shell 20A. The first fin 40A has a proximal end 42 and a distal end 44. The proximal end 42 is secured to the shell 20A while the distal end 44 is disposed within the cavity 26A.

A second fin 46 is rigidly secured to the shell 20A along the length thereof between the first and second end 22A and 24A, respectively, of the shell 20A. The second fin 46 is secured diametrically opposite to the first fin 40A. The second fin 46 is curved in an opposite direction to the first fin 40A. The second fin has a radius of curvature R" which is less than the radius of curvature R' of the shell 20A. The second fin 46 has a proximal and a distal end 48 and 50, respectively. The proximal end 48 of the second fin 46 is secured to the shell 20A diametrically opposite to the proximal end 42 of the first fin 40A. The distal end 50 is disposed within the cavity 26A such that when the shell is rotated, as indicated by the arrow 30A, the fins 40A and 46 interact with air within the cavity 26A for generating the flow of air 32A through the perforate shell 20A towards the cavity 26A.

Figure 6:
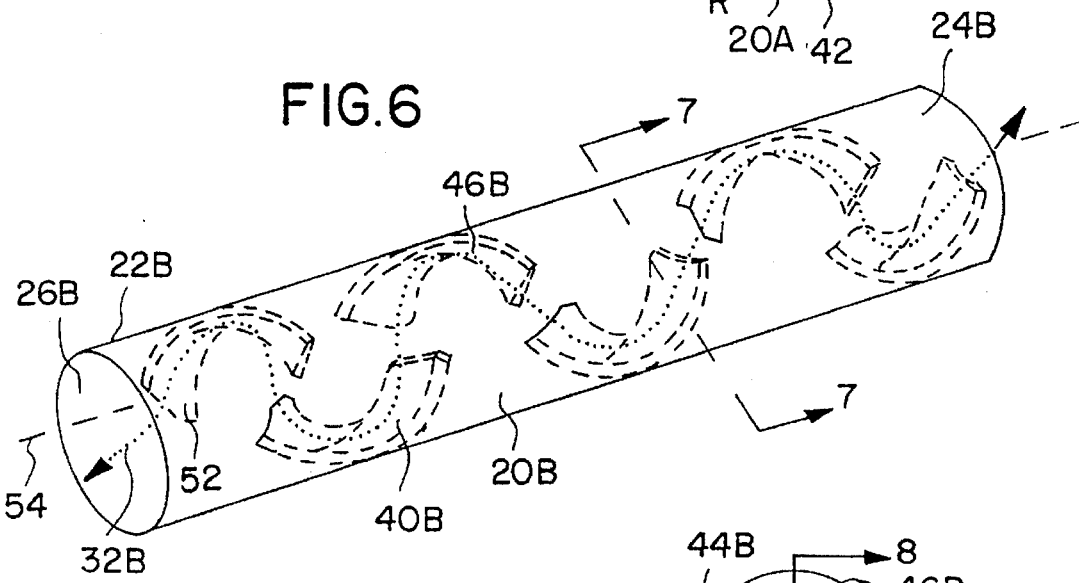
FIG. 6 is a perspective view similar to that shown in FIG. 2, but showing another embodiment of the present invention.
Figure 7:
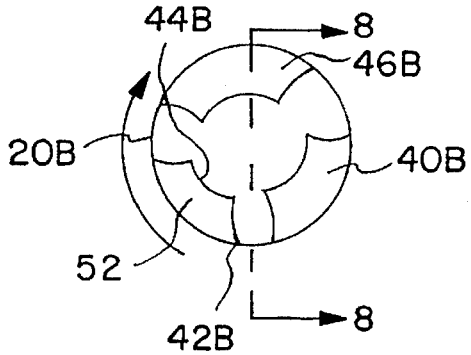
FIG. 7 is a sectional view taken on the line 7—7 of FIG. 6.

FIGS. 6 and 7 show a further embodiment of the present invention in which the fin means 28B includes a plurality of fins 40B, 46B and 52. The fins 40B, 46B and 52 are secured to the shell 20B and are disposed within the cavity 26B in a spiral configuration. Each of the fins 40B, 46B and 52 includes a proximal end 42B secured to the shell 20B and a distal end 44B which extends towards a rotational axis 54 of the shell 20B. The arrangement is such that when the shell 20B rotates, the flow of air 32B through the shell 20B towards the cavity 26B is generated. Additionally, the fins 40B, 46B and 52 pump the air within the cavity 26B towards the first and second ends 22B and 24B, respectively, of the shell 20B.

Figure 8:
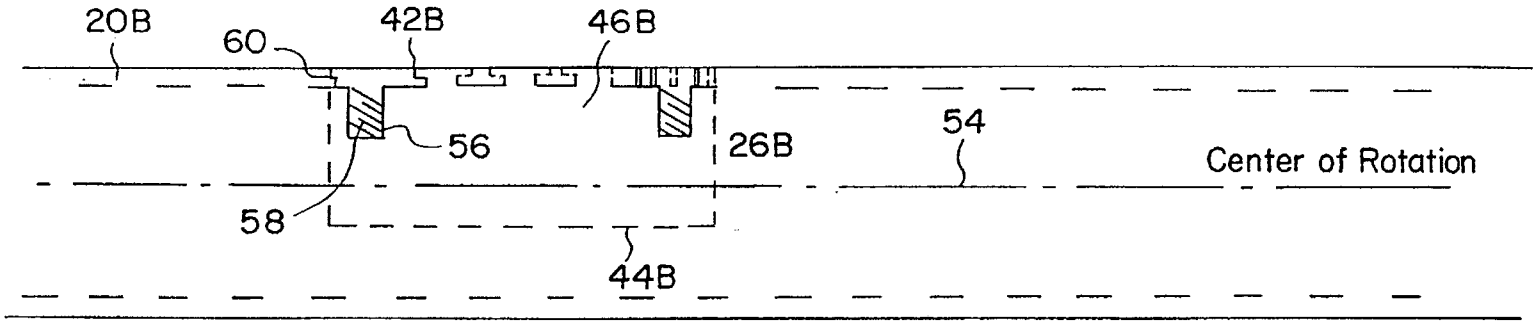
FIG. 8 is a sectional view taken on the line 8—8 of FIG. 7 to show the means for fastening the fins within the shell of the vacuum roll apparatus.

As shown in FIG. 8, each fin, for example fin 46B of the plurality of fins 40B, 46B and 52, further includes a threaded bore 56 which extends from the proximal end 42B towards the distal end 44B.

Additionally, a threaded fastener 58 extends through an aperture 60 defined by the shell 20B. The threaded fastener 58 cooperates with the threaded bore 56 for anchoring the fin 46B within the cavity 26B.

Figure 9:
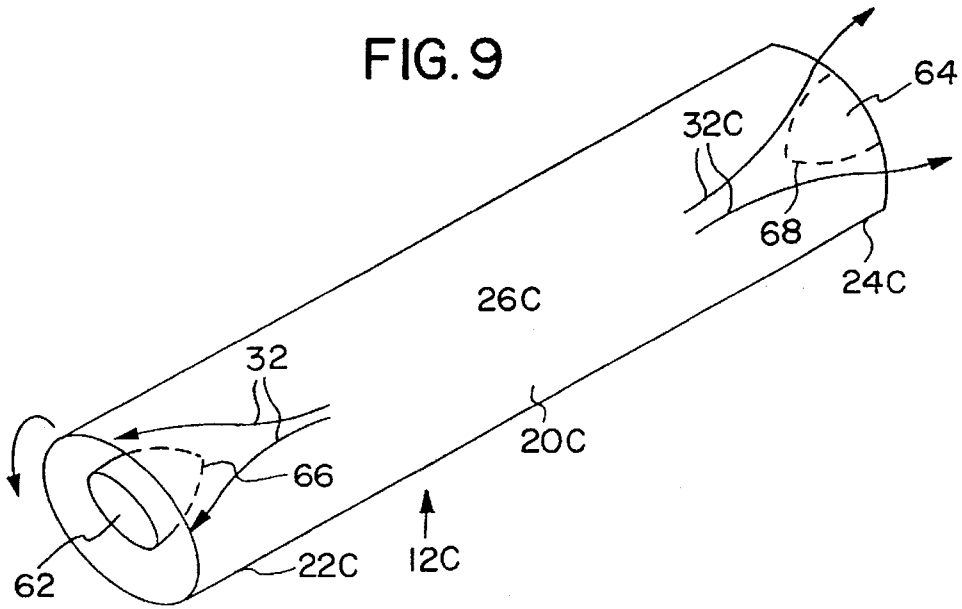
FIG. 9 is a perspective view similar to that shown in FIG. 2, but showing yet another embodiment of the present invention which includes a first and second cone-shaped flow deflector.

In another embodiment of the present invention as shown in FIG. 9, the vacuum roll apparatus 12C further includes a first cone-shaped flow deflector 62 which is disposed adjacent to the first end 22C of the shell 20C.

A second cone-shaped flow deflector 64 is disposed adjacent to the second end 24C of the shell 20C. The arrangement is such that the apices 66 and 68 of the flow deflectors 62 and 64 face towards each other and are disposed within the cavity 26C for facilitating a smooth flow of the air 32C from the cavity 26C.

It will be understood by those skilled in the art that the vacuum roll according to the present invention may be connected at either end thereof, or at both ends, to a source of partial vacuum in order to increase the flow of air 32 through the vacuum roll.

The present invention provides a simple and inexpensive vacuum roll apparatus that requires-little maintenance and which enhances the laminar flow therefrom of air drawn into the roll shell through the perforate surface thereof.

What is claimed is:

1. A vacuum roll apparatus for transferring a web supported on a dryer felt from a first or second drying cylinder of a dryer section, said apparatus comprising:

a rotatable perforate shell having a first and a second end, said shell defining a cavity extending from said first to said second end of said shell, the arrangement being such that the dryer felt extends from the first dryer around said perforate shell to said second dryer, the web extending contiguously with the dryer felt with the dryer felt disposed between the said shell and the web;

fin means rigidly secured to said shell and disposed within said cavity such that when said shell is being rotated, said fin means generate the flow of air through said perforate shell toward said cavity for drawing the web into close conformity with the dryer felt during movement thereof over the vacuum roll apparatus so that the web is restrained against cross-machine directional shrinkage; and said fin means including:

a fin extending substantially diametrically across said cavity from said first to said second end.

2. A vacuum roll apparatus as set forth in claim 1, wherein said perforate shell is cylindrical in configuration having an outer cylindrical surface which defines a plurality of holes which extend from said outer surface to said cavity.

3. A vacuum roll apparatus as set forth in claim 1, wherein said fin means includes:

a plurality of fins, said fins being secured to said shell and disposed within said cavity in a spaced configuration, each of said fins including a proximal end secured to said shell and a distal end extending towards a rotational axis of said shell, the arrangement being such that when said shell rotates, said flow of air through said shell towards said cavity is generated, said fins also pumping said air towards said first and second ends of said shell.

4. A vacuum roll apparatus as set forth in claim 3, wherein each fin of said plurality of fins further includes:

a threaded bore extending from said proximal end towards said distal end;

a threaded fastener extending through an aperture defined by said shell and cooperating with said threaded bore for anchoring said fin within said cavity.

* * * * *